US007905479B2

(12) United States Patent
Samoto

(10) Patent No.: US 7,905,479 B2
(45) Date of Patent: Mar. 15, 2011

(54) FEEDER UNIT, SHEET FEEDING DEVICE, AND IMAGE FORMING APPARATUS

(75) Inventor: Kenji Samoto, Aichi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 165 days.

(21) Appl. No.: 12/415,202

(22) Filed: Mar. 31, 2009

(65) Prior Publication Data

US 2009/0250867 A1 Oct. 8, 2009

(30) Foreign Application Priority Data

Apr. 8, 2008 (JP) ..... 2008-100808

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS

| | | | | |
|---|---|---|---|---|
| 5,421,569 | A * | 6/1995 | Davidson | 271/109 |
| 6,651,972 | B2 * | 11/2003 | Hsiao et al. | 271/114 |
| 6,969,058 | B2 * | 11/2005 | Gaarder et al. | 271/10.04 |
| 7,059,596 | B2 | 6/2006 | Iwase | |
| 7,370,857 | B2 * | 5/2008 | Otsuki | 271/114 |
| 7,435,025 | B2 * | 10/2008 | Tanahashi et al. | 400/625 |
| 7,506,867 | B2 * | 3/2009 | Lee et al. | 271/117 |
| 7,559,545 | B2 * | 7/2009 | Asada | 271/117 |
| 7,614,621 | B2 * | 11/2009 | Asada | 271/117 |
| 7,722,030 | B2 * | 5/2010 | Sugiyama et al. | 271/117 |
| 2002/0054381 | A1 * | 5/2002 | Iwase | 358/498 |
| 2005/0194732 | A1 | 9/2005 | Asada | |
| 2007/0267804 | A1 * | 11/2007 | Kozaki et al. | 271/113 |

FOREIGN PATENT DOCUMENTS

| | | |
|---|---|---|
| JP | 2002-060068 | 2/2002 |
| JP | 2005-247521 | 9/2005 |

* cited by examiner

*Primary Examiner* — Stefanos Karmis
*Assistant Examiner* — Luis Gonzalez
(74) *Attorney, Agent, or Firm* — Banner & Witcoff, Ltd.

(57) ABSTRACT

A feeder unit to feed sheets is provided. The feeder unit includes a main frame, being swingably supported at a pivotal end by a first shaft, and arranged to extend from the first shaft toward an upper level of a tray, a rotary member, which is rotatably supported, and is arranged to come in contact with a topmost surface of the sheets, a pair of opposing walls, formed in the main frame, a secondary frame, having a pair of supporting walls which come to face the opposing walls, a gear train to transmit rotation force to the rotary member, a positioning system to situate the secondary frame in a predetermined position, and a detachment restricting system to restrict the secondary frame from being detached from the main frame. The secondary frame is situated in the predetermined position when the rotary member rotates in a direction to feed the sheets.

20 Claims, 14 Drawing Sheets

FEEDER UNIT, SHEET FEEDING DEVICE, AND IMAGE FORMING APPARATUS

CROSS REFERENCE TO RELATED APPLICATION

This application claims priority from Japanese Patent Application No. 2008-100808 filed on Apr. 8, 2008, the entire subject matter of which is incorporated herein by reference.

BACKGROUND

1. Technical Field

Aspects of the present invention relate to a feeder unit to feed sheets contained in a tray into a feeding path, a sheet feeding device having the feeder unit, and an image forming apparatus having the sheet feeding device. More specifically, a feeder unit having a main frame and a secondary frame, whilst the secondary frame is capable of being installed in a correct position of the main frame easily, is provided. Further, a sheet feeding device having the feeder unit and an image forming apparatus having the sheet feeding device are provided.

2. Related Art

Conventionally, a sheet feeding device to separate a sheet from a sheet stack contained in a tray and forward the separated sheet in a feeding path has been known. The sheet feeding device has a feed roller, which is in a position to be in contact with a topmost sheet in the sheet stack, so that the topmost sheet can be separated from the sheet stack by contact friction generated between the topmost sheet and the feed roller whilst the feed roller rotates. In Japanese Patent Provisional Publications No. 2002-60068 and No. 2005-247521, for example, a sheet feeding device having a frame with a swingable arm portion and a feed roller to rotate at the swingable end of the arm portion is disclosed. Rotation force (torque) from a motor is conveyed to the fed roller through gears which are rotatably supported by the frame.

The frame to rotatably support the gears can be molded out of rather inexpensive materials (e.g., resin) in consideration of manufacturing cost and convenience, weight saving, etc. However, the frame is often subject to distortional stress, which can be caused by feeding load in the feed roller and driving torques of the motor. Therefore, it is required that the frame is made of a material with rigidity. Further, the frame is required to be molded with dimensional accuracy in order to avoid irregular feeding and misalignment in a feeding path, and to feed the sheets smoothly and uniformly.

Furthermore, because the gears are rotatable in the frame, bearings to hold the gears are subject to wear away due to rotating friction. When the bearings are abraded and eroded, positions to hold the gears may be displaced, and the rotating force of the motor may not be effectively conveyed to the feed roller. Therefore, the frame is required to be molded out of a material with abrasion resistance. Often, the material with high rigidity, easy moldability, and high abrasion resistance can be rather costly.

In order to overcome the above difficulties, it is possible to form the bearings and the frame separately in different materials and to attach the bearings to the frame afterwards. In this configuration, the frame can be made of a material with higher rigidity and moldability but lower abrasion resistance whilst the bearings can be made of a material with higher abrasion resistance. Thus, the frame and the bearings can be made of different materials which are suitable to respective components; i.e., the frame can be made of a material which is inexpensive and suitable to the frame, and the bearings can be made of a material which is inexpensive and suitable to the bearings.

SUMMARY

Meanwhile, when the frame and the bearings are formed separately, it is required that the bearings are attached to the frame in specifically accurate positions with respect to the frame. When not in correct positions, the bearings can be deformed and/or displaced, and engagement accuracy of the gears is lowered; thus, the rotating force of the motor is not effectively transmitted to the feed roller. Instead, the gear teeth and the bearings are subject to excessive load and may be abraded to be corrupted. Moreover, the gears can be disengaged. Yet, placing the bearings accurately in correct positions is accompanied by difficulties.

In view of the above drawbacks, the present invention is advantageous in that a feeder unit, a sheet feeding device, and an image forming apparatus, having a detachable frame being attached to a main frame accurately and easily in a predetermined position so that transmission efficiency can be maintained and components can be prevented from being abraded even against intense rotation force, are provided.

According to an aspect of the present invention, a feeder unit to feed sheets, which are stacked in a tray, in a predetermined feeding direction, is provided. The feeder unit includes a main frame, having a pivotal end and a swingable end, being swingably supported at the pivotal end by a first shaft arranged substantially above the tray, having an upper surface and a lower surface, and arranged to extend from the first shaft toward an upper level of the tray with the lower surface facing the tray, a rotary member, which is arranged at the swingable end of the main frame, is rotatably supported by a second shaft extending in a same direction with the first shaft, and is arranged to come in contact with a topmost surface of the sheets stacked in the tray, a pair of opposing walls, which are formed in the main frame, and of which planes are perpendicular to the direction of the first shaft, a secondary frame, having a pair of supporting walls which come to face the opposing walls when the secondary frame is inserted in space partitioned by the opposing wall in the main frame through an opening, the opening formed on either surface of the main frame, a gear train including a plurality of gears to transmit predetermined rotation force to the rotary member, each of the gears being rotatable about a third shaft extending in the same direction with the first shaft and is rotatably supported by the pair of supporting walls, a positioning system to situate the secondary frame in a predetermined position in the partitioned space, and a detachment restricting system to restrict the secondary frame from being detached from the main frame. The secondary frame is situated in the predetermined position of the main frame when the rotary member rotates in a direction to feed the sheets.

According to another aspect of the present invention, a sheet feeding device is provided. The sheet feeding device includes a feeder unit to feed sheets in a sheet stack in a predetermined feeding direction, a transmission system to transmit rotating force from a drive source to the feeder unit, and a tray to contain the sheet stack. The feeder unit includes a main frame, having a pivotal end and a swingable end, being swingably supported at the pivotal end by a first shaft arranged substantially above the tray, having an upper surface and a lower surface, and arranged to extend from the first shaft toward an upper level of the tray with the lower surface facing the tray, a rotary member, which is arranged at the swingable end of the main frame, is rotatably supported by a second shaft extending in a same direction with the first shaft, and is arranged to come in contact with a topmost surface of the sheets stacked in the tray, a pair of opposing walls, which are formed in the main frame, and of which planes are perpendicular to the direction of the first shaft, a secondary frame, having a pair of supporting walls which come to face the opposing walls when the secondary frame is inserted in space partitioned by the opposing wall in the main frame through an opening, the opening formed on either surface of the main frame, a gear train including a plurality of gears to transmit predetermined rotation force to the rotary member, each of the gears being rotatable about a third shaft extending in the same direction with the first shaft and is rotatably supported by the pair of supporting walls, a positioning system to situate the secondary frame in a predetermined position in the partitioned space, and a detachment restricting system to restrict the secondary frame from being detached from the main frame. The secondary frame is situated in the predetermined position of the main frame when the rotary member rotates in a direction to feed the sheets.

According to still another aspect of the present invention, an image forming apparatus is provided. The image forming apparatus includes a feeder unit to feed sheets in a sheet stack in a predetermined feeding direction, a transmission system to transmit rotating force from a drive source to the feeder unit, and a tray to contain the sheet stack, an image forming unit to form images on the sheets being fed. The feeder unit includes a main frame, having a pivotal end and a swingable end, being swingably supported at the pivotal end by a first shaft arranged substantially above the tray, having an upper surface and a lower surface, and arranged to extend from the first shaft toward an upper level of the tray with the lower surface facing the tray, a rotary member, which is arranged at the swingable end of the main frame, is rotatably supported by a second shaft extending in a same direction with the first shaft, and is arranged to come in contact with a topmost surface of the sheets stacked in the tray, a pair of opposing walls, which are formed in the main frame, and of which planes are perpendicular to the direction of the first shaft, a secondary frame, having a pair of supporting walls which come to face the opposing walls when the secondary frame is inserted in space partitioned by the opposing wall in the main frame through an opening, the opening formed on either surface of the main frame, a gear train including a plurality of gears to transmit predetermined rotation force to the rotary member, each of the gears being rotatable about a third shaft extending in the same direction with the first shaft and is rotatably supported by the pair of supporting walls, a positioning system to situate the secondary frame in a predetermined position in the partitioned space, and a detachment restricting system to restrict the secondary frame from being detached from the main frame. The secondary frame is situated in the predetermined position of the main frame when the rotary member rotates in a direction to feed the sheets.

According to the above configurations, the secondary frame can be effectively and securely settled in the predetermined position with respect to the main frame by utilizing the force acting on the gears which are supported by the secondary frame. Therefore, transmission efficiency can be maintained, and components of the feeder unit can be prevented from being abraded against intense rotation force. Further, the secondary frame and the gear train can be easily settled in the main frame.

BRIEF DESCRIPTION OF THE ACCOMPANYING DRAWINGS

DETAILED DESCRIPTION

Figure 1:
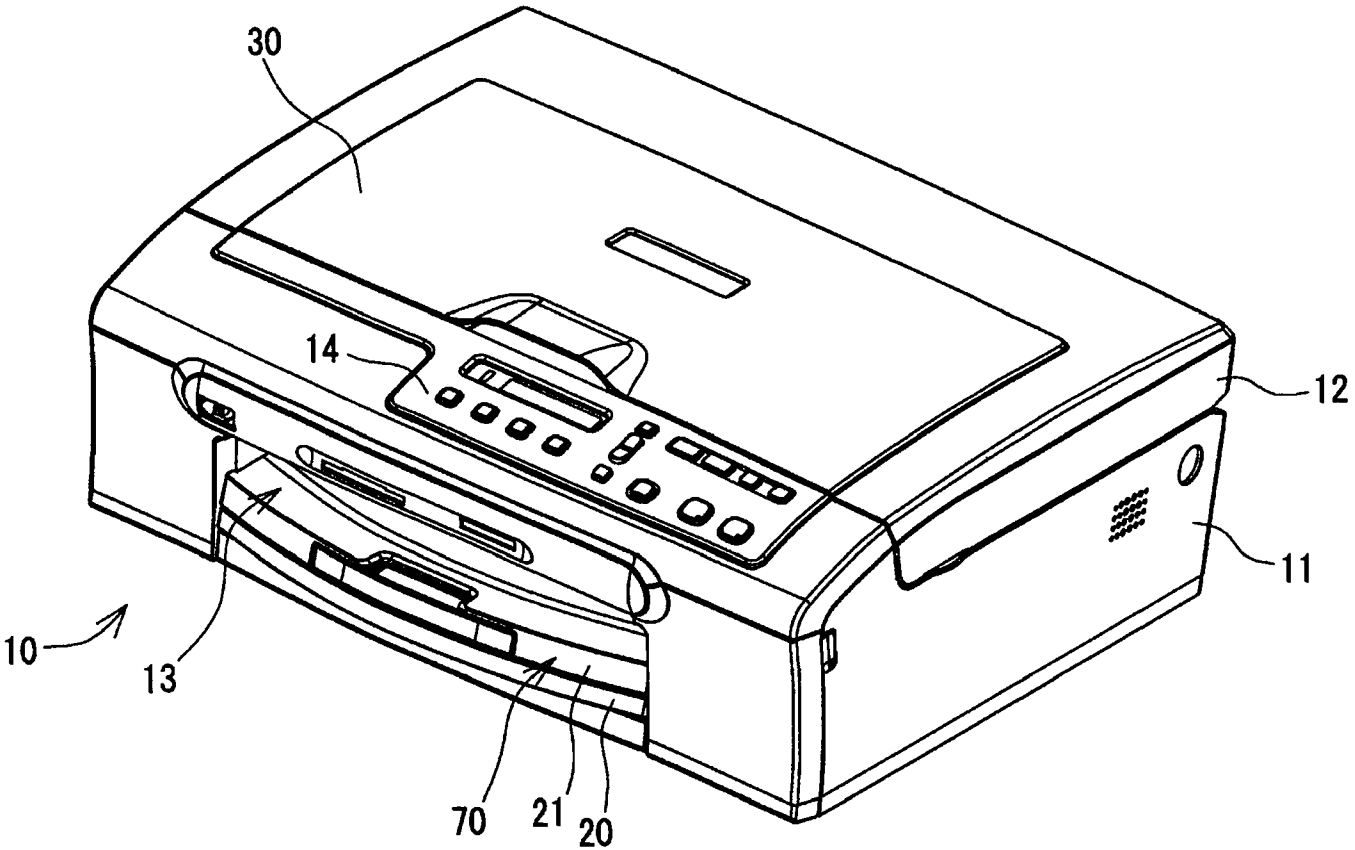
FIG. 1 illustrates an external and perspective view of an MFD (multi-function device) 10 according to an embodiment of the present invention.

Hereinafter, an embodiment according to an aspect of the present invention will be described with reference to the accompanying drawings. First, an overall configuration of an MFD 10 according to the embodiment of the present invention will be described. FIG. 1 illustrates an external and perspective view of the MFD 10 according to the embodiment of the present invention.

The MFD 10 according to the present embodiment is configured integrally with a printer unit 11 and a scanner unit 12 and provided with functionalities for printing, scanning, and facsimile transmission. In the present embodiment, the printer unit 11 is configured to print an image in an inkjet printing method; however, the printer unit 1 may form images in a different printing method such as laser printing. Further, according to the present invention, the MFD 10 may be replaced with a printer device having solely a printing function.

A body of the MFD 10 according to the present invention has an approximate shape of a box with a width and a depth being respectively greater than a height. The scanner unit 12 being a flatbed scanner is provided at an upper portion of the MFD 10, and a topmost portion includes a document cover 30, which is openable/closable with respect to the body of the MFD 10. The scanner unit 12 includes a contact glass and an image sensor (not shown) underneath the document cover 30. When an original document with an image formed thereon is set on the contact glass and a scanning operation is started, the image is read by the image sensor.

The printer unit 11 is provided in a bottom portion of the MFD 10. The printer unit 11 is configured to form an image on a recording sheet according to print data, which can be entered through the scanner unit 12 and from an external environment. The printer unit 11 includes a sheet cassette 70, which stores recording sheets therein and is detachably attached to the MFD 10 through an opening 13. The recording sheets stored in the sheet cassette 70 are fed by a feeder 16 along a sheet feeding path to a recording unit 24, in which the image is formed.

The MFD 10 is provided with an operation panel 14 in an upper front portion thereof. (In the present embodiment, a near left side in FIG. 2 corresponds to the front of the MFD 10.) The operation panel 14 includes a liquid crystal display, which presents various information concerning operations, and keys, through which a user enters information. The MFD 10 operates according to the information and instructions entered through the operation panel 14 and transmitted from external devices.

Figure 2:
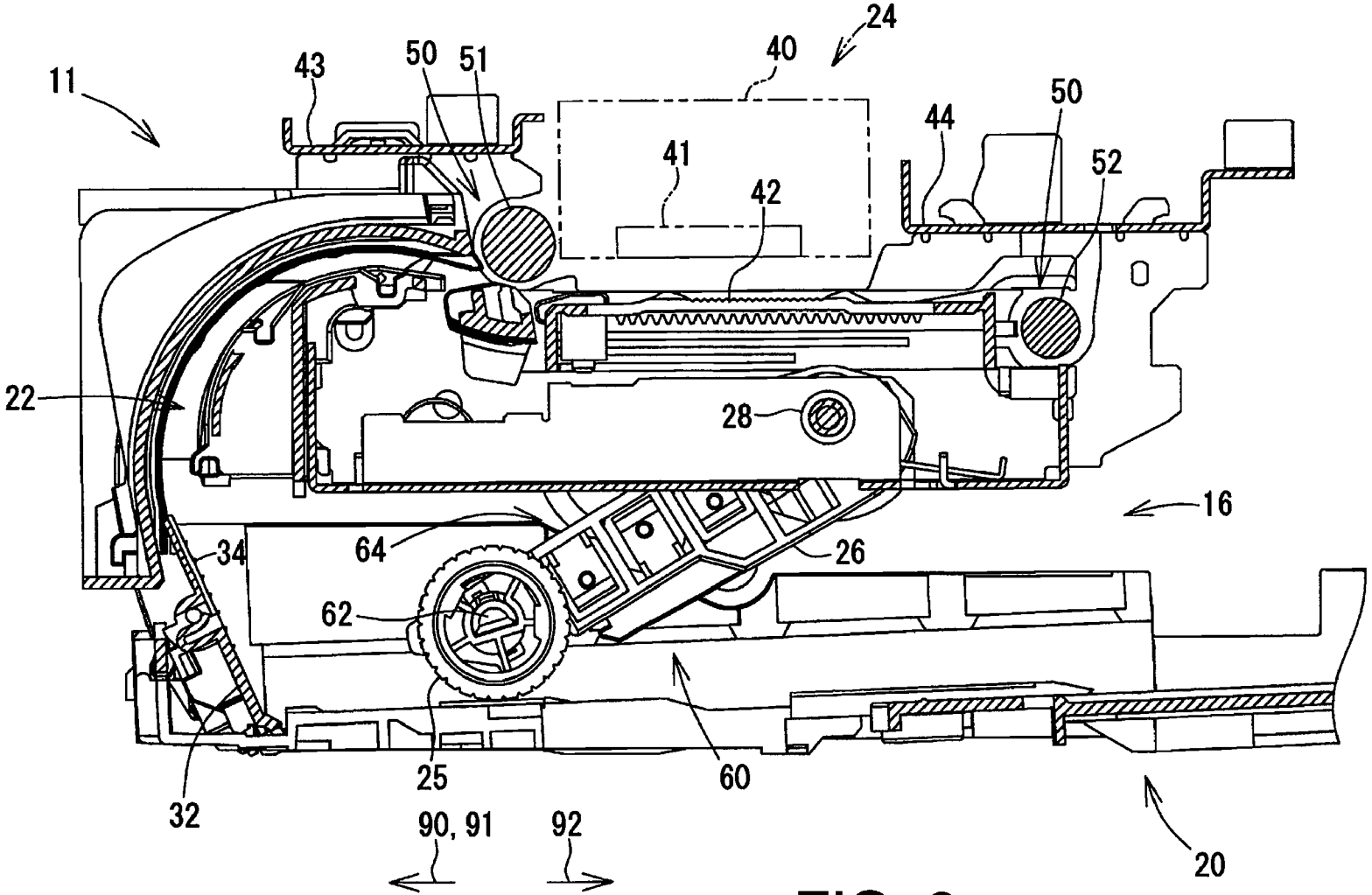
FIG. 2 illustrates a partial and cross-sectional side view of a printer unit 11 in the MFD 10 according to the embodiment of the present invention.

Next, the printer unit 11 will be described herein below with reference to FIG. 2. FIG. 2 illustrates a partial and cross-sectional side view of the printer unit 11 in the MFD 10 according to the embodiment of the present invention.

The printer unit 11 includes the feeder 16, the recording unit 24, and a carrier unit 50. Further, the feeder 16 includes the sheet cassette 70, a feeding unit 60, and a drive force conveyer system 27 (see FIG. 5). In FIG. 2, the recording unit 24 is indicated in a double-dotted line.

The sheet cassette 70 in the feeder 16 is configured to be inserted into the printer unit 11 through the opening 13 (see FIG. 1) in an inserting direction 90 and withdrawn from the printer unit 11 in a withdrawal direction 92. The sheet cassette 70 includes a sheet tray 20 and a discharge tray 21 (see FIG. 1), and the recording sheets in a stack are stored in the sheet tray 20. The recording sheets which have been through the printing operation to be formed images thereon are discharged and received in the discharge tray 21. In the present embodiment, the inserting direction 90 corresponds to a feeding direction 91, in which the recording sheets stored in the sheet tray 20 are lead to a guide path 22.

Figure 3:
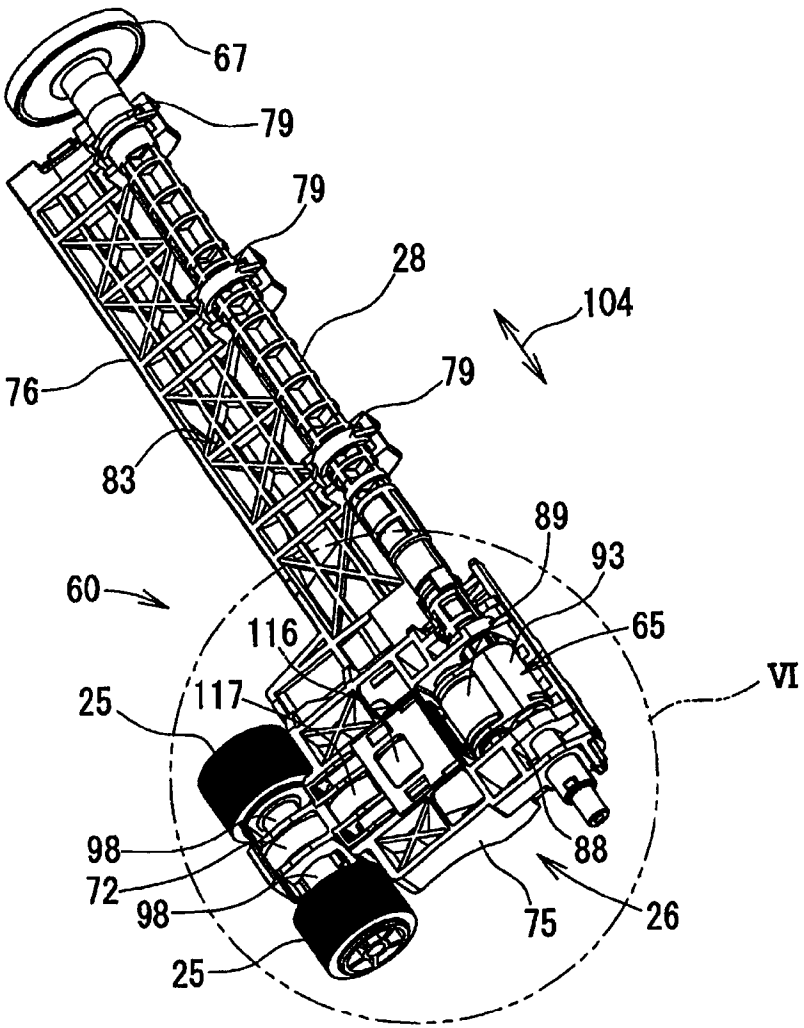
FIG. 3 illustrates a perspective top view of a feeding unit 60 in the MFD 10 according to the embodiment of the present invention.
Figure 4:
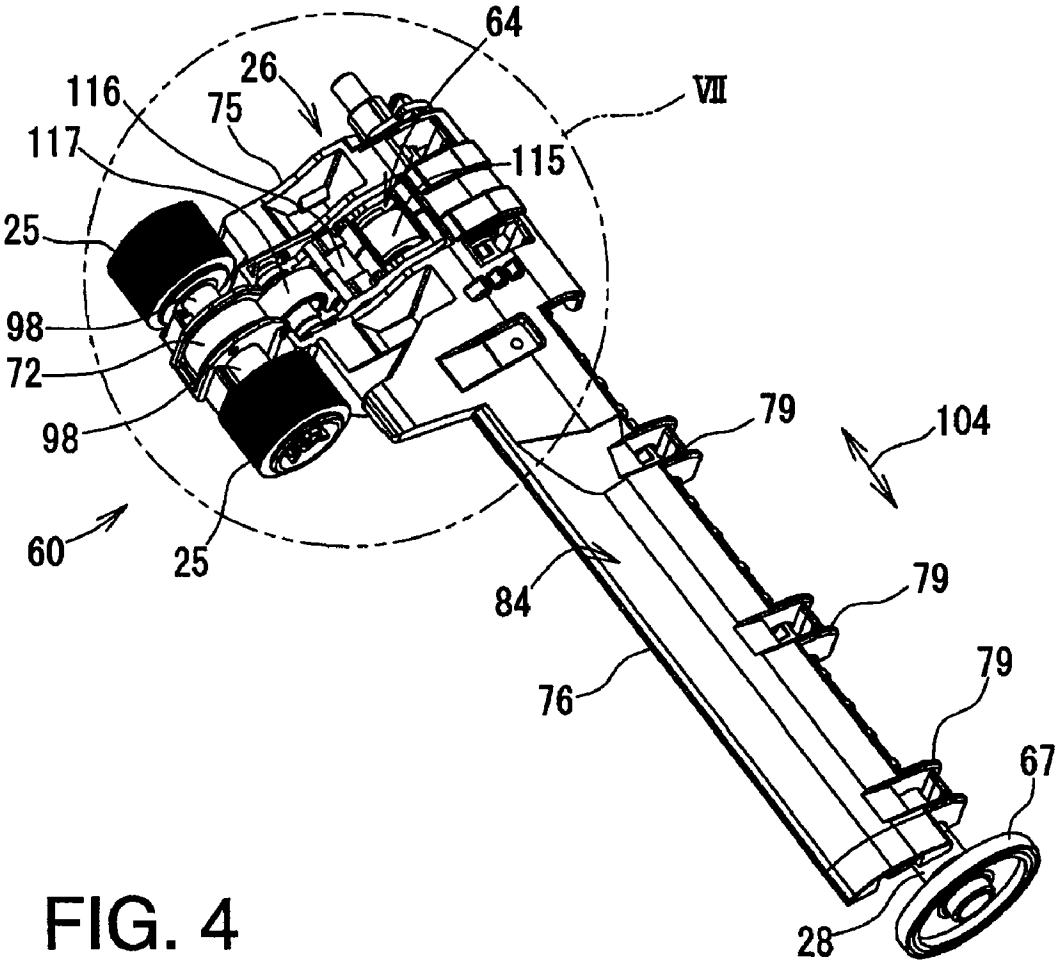
FIG. 4 illustrates a perspective bottom view of the feeding unit 60 in the MFD 10 according to the embodiment of the present invention.
Figure 5:
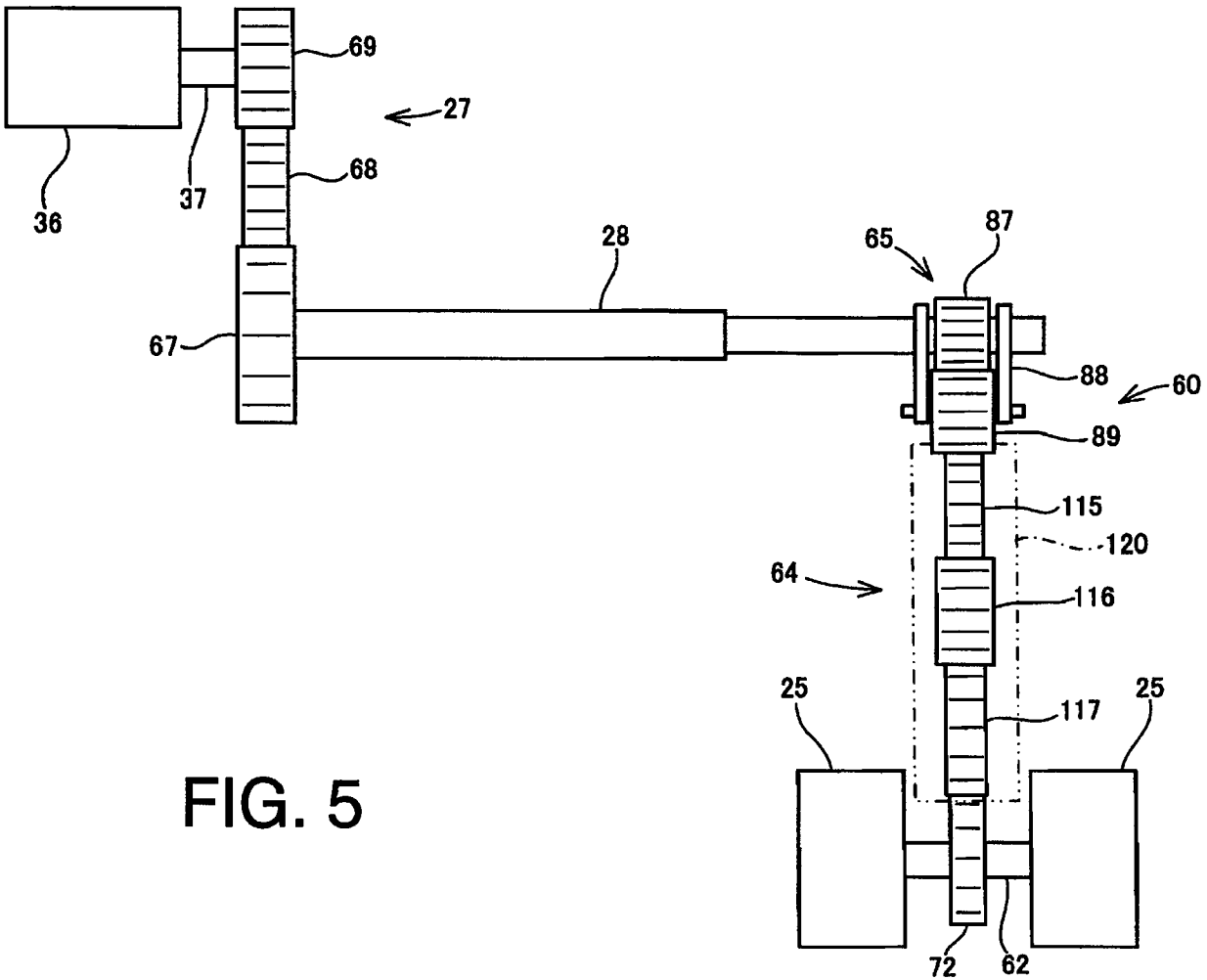
FIG. 5 illustrates a pathway of driving force from a motor 36 to feed rollers 25 in the MFD 10 according to the embodiment of the present invention.

The feeding unit 60 feeds the recording sheets stored in the sheet tray 20 in the feeding direction 91 and includes a swingable arm 26, feed rollers 25, a conveyer gear unit 64, and a planetary gear unit 65 (see FIG. 3). FIG. 3 illustrates a perspective top view of the feeding unit 60 in the MFD 10 according to the embodiment of the present invention. FIG. 4 illustrates a perspective bottom view of the feeding unit 60 in the MFD 10 according to the embodiment of the present invention. FIG. 5 illustrates a pathway of driving force from a motor 36 to the feed roller 36 in the MFD 10 according to the embodiment of the present invention.

The swingable arm 26 is arranged substantially above the sheet tray 20. The feed rollers 25, the conveyer gear unit 64, and the planetary gear unit 65 are provided to the swingable arm 26. The swingable arm 26 is swingably supported at a pivotal end thereof by a drive shaft 28, which is provided above the sheet tray 20.

The swingable arm 26 is molded out of synthetic resin with higher moldability and rigidity (e.g., ABS resin). As shown in FIG. 2, the swingable arm 26 is arranged in the feeding unit 60 to extend from the drive shaft 28 toward an upper level of the sheet tray 20 in an inclined attitude to orient a downstream side of the feeding direction 91 (i.e., toward a lower left-hand side in FIG. 2). A pair of feed rollers 25 is arranged at a swingable end, which is an end further from the swing axis (i.e., the drive shaft 28), of the swingable arm 26. An image of the swingable arm 26 is omitted from the feeding unit 60 shown in FIG. 5.

The feed rollers 25 are configured to come in contact with a topmost surface of the recording sheets stored in the sheet tray 20 and rotate about a roller shaft 62 to feed the recording sheets in the feeding direction 91. The roller shaft 62 extends in parallel with an axial direction of the drive shaft 28 and is provided with one of the feed rollers 25 at each axial end thereof (see FIG. 3). The roller shaft 62 is further provided with a conveyer gear 72, which is engaged with a conveyer gear 117 in the conveyer unit 64, which will be described later in detail.

The drive shaft 28 extends in parallel with a widthwise direction of the MFD 10 (i.e., perpendicularly to the cross-sectional plane in FIG. 2) and is supported by a frame (not shown), which is a part of a chassis of the printer unit 11, at each end thereof. At one end of the drive shaft 28, as shown in FIGS. 3-5, a conveyer gear 67 is provided. When the conveyer gear 67 rotates, the drive shaft 28 rotates in a same direction accordingly. The conveyer gear 67 is coupled to a drive force conveyer system 27, which includes conveyer gears 68, 69. Specifically, the conveyer gear 68 in the drive force conveyer system 27 is engaged with the conveyer gear 67. The conveyer gear 68 is engaged with the conveyer gear 69, which is fixed to an output shaft 37 of the motor 36. The motor 36 is controlled by a motor driver (not shown) to rotate in either direction. When the motor 36 is rotated by the motor driver, the rotation of the motor 36 is transmitted to a planetary gear unit 65, which will be described later, and further through a transmission system, which includes the output shaft 37, the drive force conveyer system 27, the conveyer gear 67, and the drive shaft 28. Thus, the drive shaft 28 is rotated in a direction, depending on the rotating direction of the motor 36.

The swingable arm 26 is provided with the conveyer gear unit 64 (see FIG. 4) and a planetary gear unit 65 (see FIG. 3). Thus, rotation of the drive shaft 28 is transmitted to the feed rollers 25 through the planetary gear unit 65, the conveyer gear unit 64, and the conveyer gear 72 so that the feed rollers 25 are rotated in a predetermined direction (i.e., a clockwise direction in FIG. 2) to feed the recording sheets stored in the sheet tray 20 in the feeding direction 91. The conveyer gear unit 64 and the planetary gear unit 65 will be described later in detail.

When the swingable arm 26 swings about the drive shaft 28, the feed rollers 25 provided at the swingable end of the swingable arm 26 is moved accordingly in directions to become closer and further from the sheet tray 20. The swingable arm 26 is pivoted to orient in a direction to droop downward by weights of the swingable arm 26 itself and the feed rollers 25 and/or expanding force of a resilient member such as a spring.

With the swingable arm 26 pivoted downward, the feed rollers 25 are pressed onto the topmost recording sheet in the sheet stack stored in the sheet tray 20. When the feed rollers 25 are rotated on the sheet stack, the topmost recording sheet is forwarded in the feeding direction due to friction generated between the feed rollers 25 and the topmost recording sheet. The friction between the feed rollers 25 and the sheet stack, which is force in a direction opposite from the rotation direction of the motor 36, affects each component included in between the motor 36 and the feed rollers 25.

The printer unit 11 includes a slope board 32, which is provided at one end of the sheet tray 20 in the feeding direction (see FIG. 2). The slope board 32 has a separator piece 34 on an inner surface thereof. When the feed rollers 25 feed the recording sheet in the feeding direction, and a front end of the recording sheet comes in contact with the slope board 23, the recording sheet is guided upward by inclination of the slope board 32. Further, when the topmost recording sheet being fed is accompanied by one or more succeeding recording sheets, the topmost recording sheet is separated from the succeeding recording sheets by the separator piece 34. The topmost recording sheet guided by the slope board 32 is directed in the guide path 22, which is provided above the slope board 32 and the feeder 16.

The guide path 22 is formed to extend upward from the slope board 32 and curved to form an arc toward the front of the printer unit 11 (i.e., rightward in FIG. 2) to lead the recording sheet therethrough, by the recording unit 24, and to the discharge tray 21 (see FIG. 1). Thus, the recording sheets stored in the sheet tray 20 are fed to the guide path 22 to be guided toward the upper portion of the printer unit 11, pass by the recording unit 24, which forms images on the recording sheets, and is discharged in the discharge tray 21.

The recording unit 24 is to form an image on the recording sheet whilst the recording sheet is carried thereby in the guide path 22. The recording unit 24 includes a carriage 40 and recording heads 41 being inkjet heads. The carriage 40 is driven by a carriage driving system (not shown) to be reciprocated in the widthwise direction of the recording sheet along guide rails 43, 44.

In the printer unit 11, a platen 42 to hold the recording sheet fed in the guide path 22 is provided along the guide path 22 in a position to oppose a lower surface of the recording unit 24. Thus, the recording sheet is maintained substantially flat on the platen 24 to have the image recorded thereon by the recording unit 24 with a predetermined clearance from the lower surface of the recording unit 24. The MFD 10 is provided with a plurality of ink cartridges (not shown), which are connected with the recording heads 41 through tubes (not shown). Colored inks contained in the ink cartridges are conveyed to the recording heads 41, and fine ink drops are selectively ejected onto the recording sheet held by the platen 42 from the recording heads 41 whilst the carriage 40 is reciprocated. Thus, the recording sheet has the image recorded thereon by the recording unit 24 whilst being fed in the guide path 22.

The printer unit 11 further includes a carrier unit 50 along the guide path 22. The carrier unit 50 includes a carrier roller 51, a discharge roller 52, and pinch rollers to be pressed by the carrier roller 51 and the discharge roller 52 respectively. The carrier roller 51 is arranged on an upstream side in the feeding direction with respect to the recording unit 24. Meanwhile, the discharge roller 52 is arranged on a downstream side in the feeding direction with respect to the recording unit 24. The recording sheet fed by the feed rollers 25 is carried to the clearance between the platen 42 and the recording unit 24 to have the image formed thereon, and the recording sheet with the formed image is discharged by the discharge roller 52 in the discharge tray 21.

Figure 6:
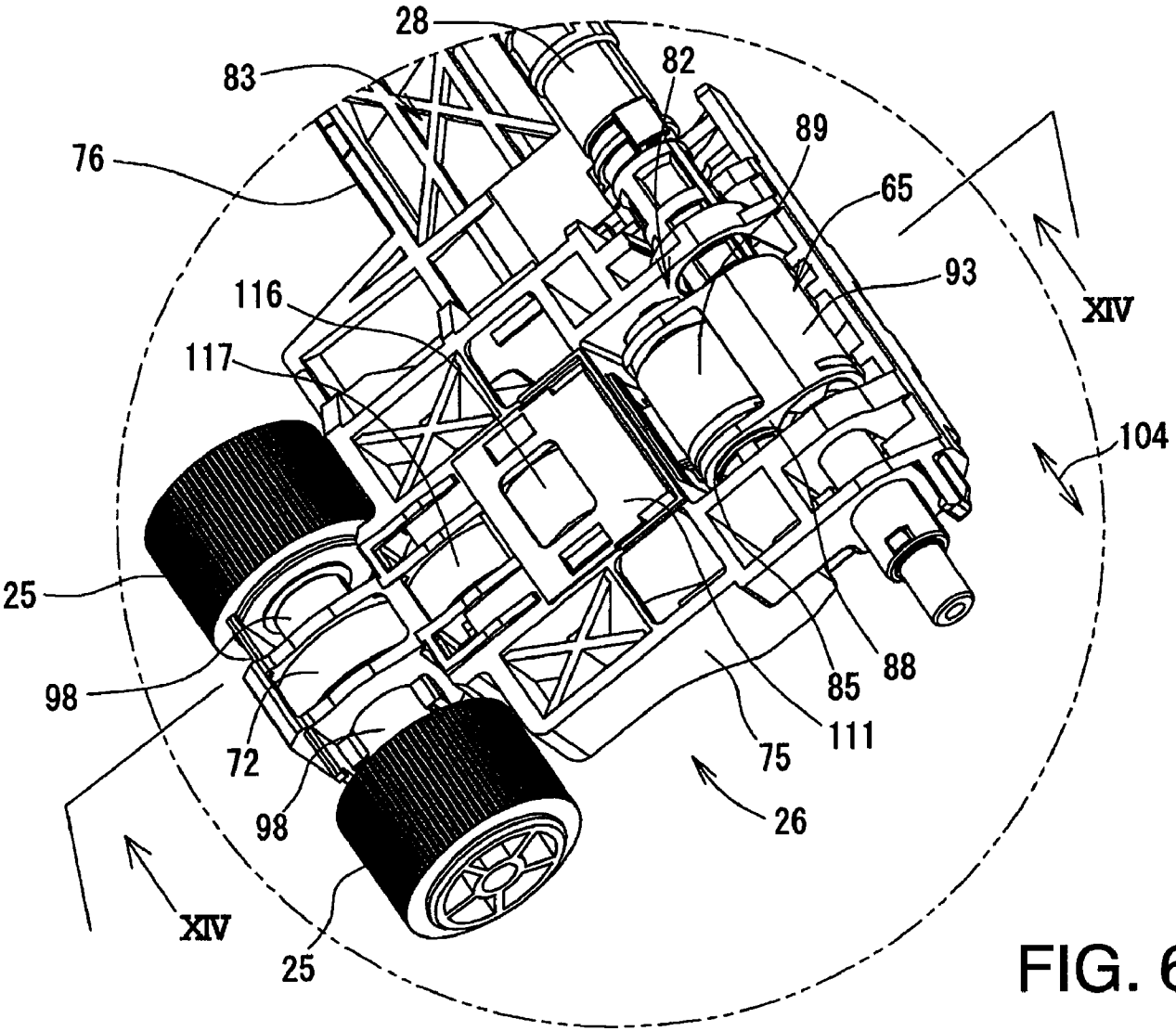
FIG. 6 illustrates an enlarged perspective view of an encircled portion VI shown in FIG. 3.
Figure 7:
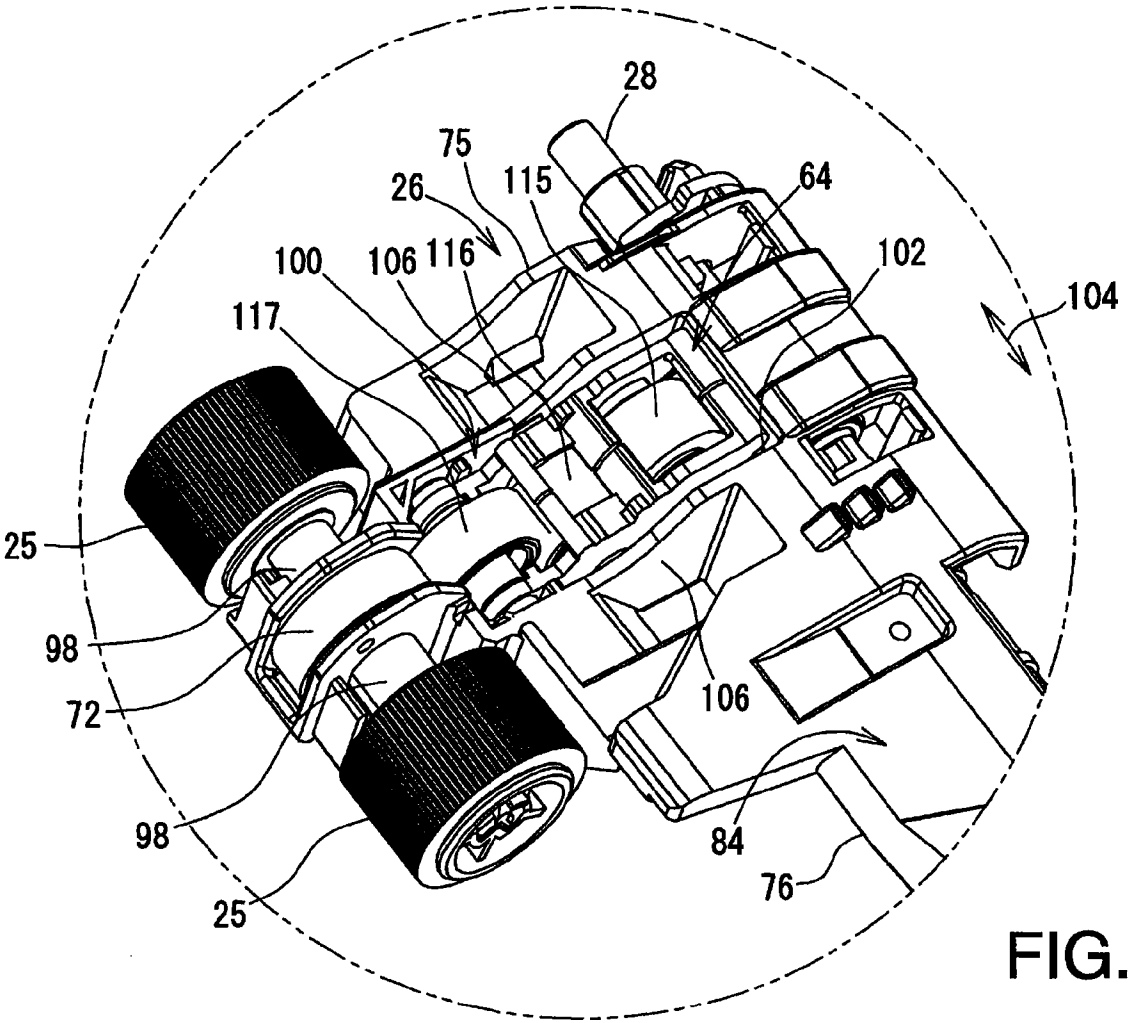
FIG. 7 illustrates an enlarged perspective view of an encircled portion VII shown in FIG. 4.
Figure 8:
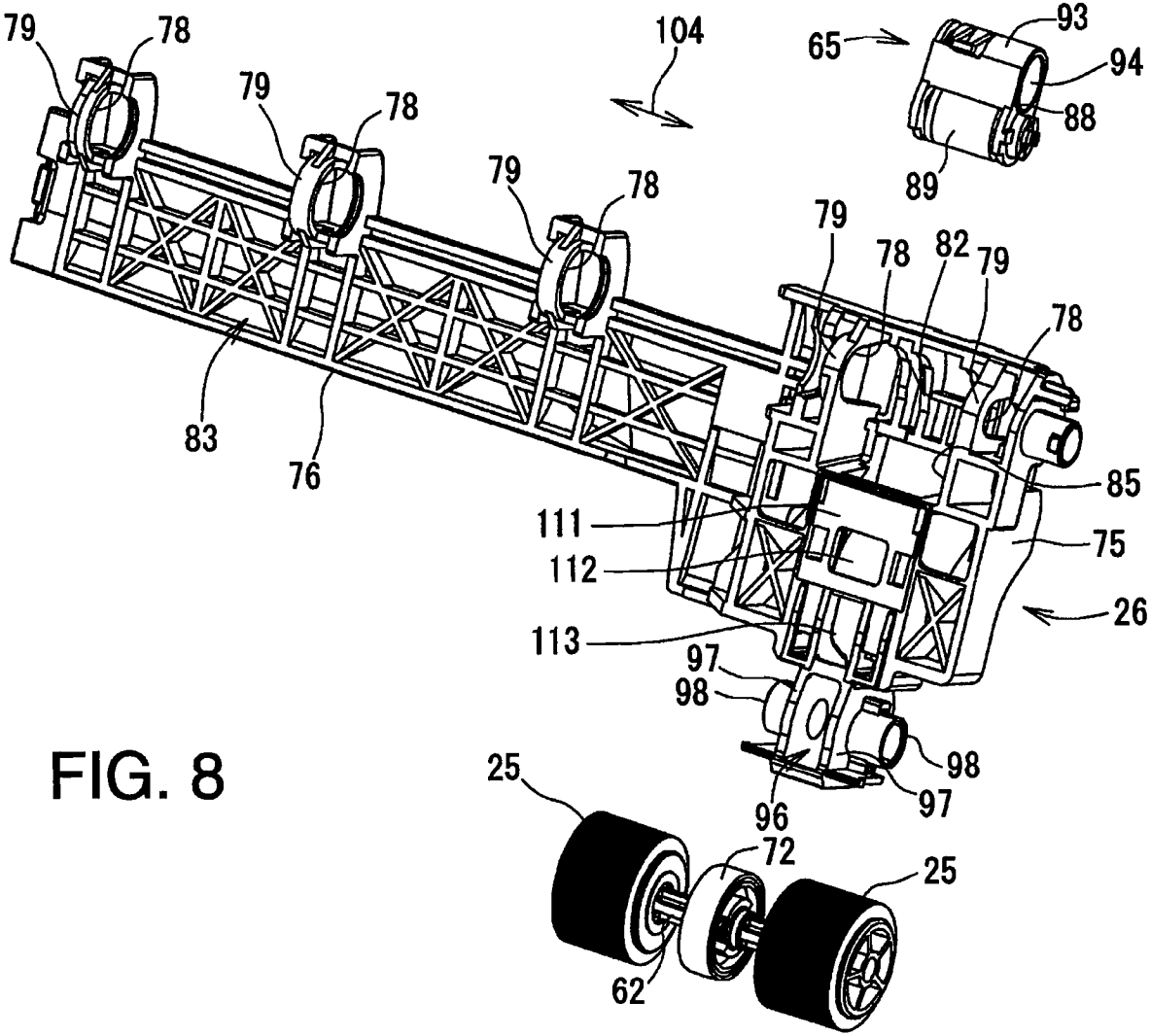
FIG. 8 illustrates an exploded view of the feeding unit 60 of the MFD 10 according to the embodiment of the present invention.
Figure 9:
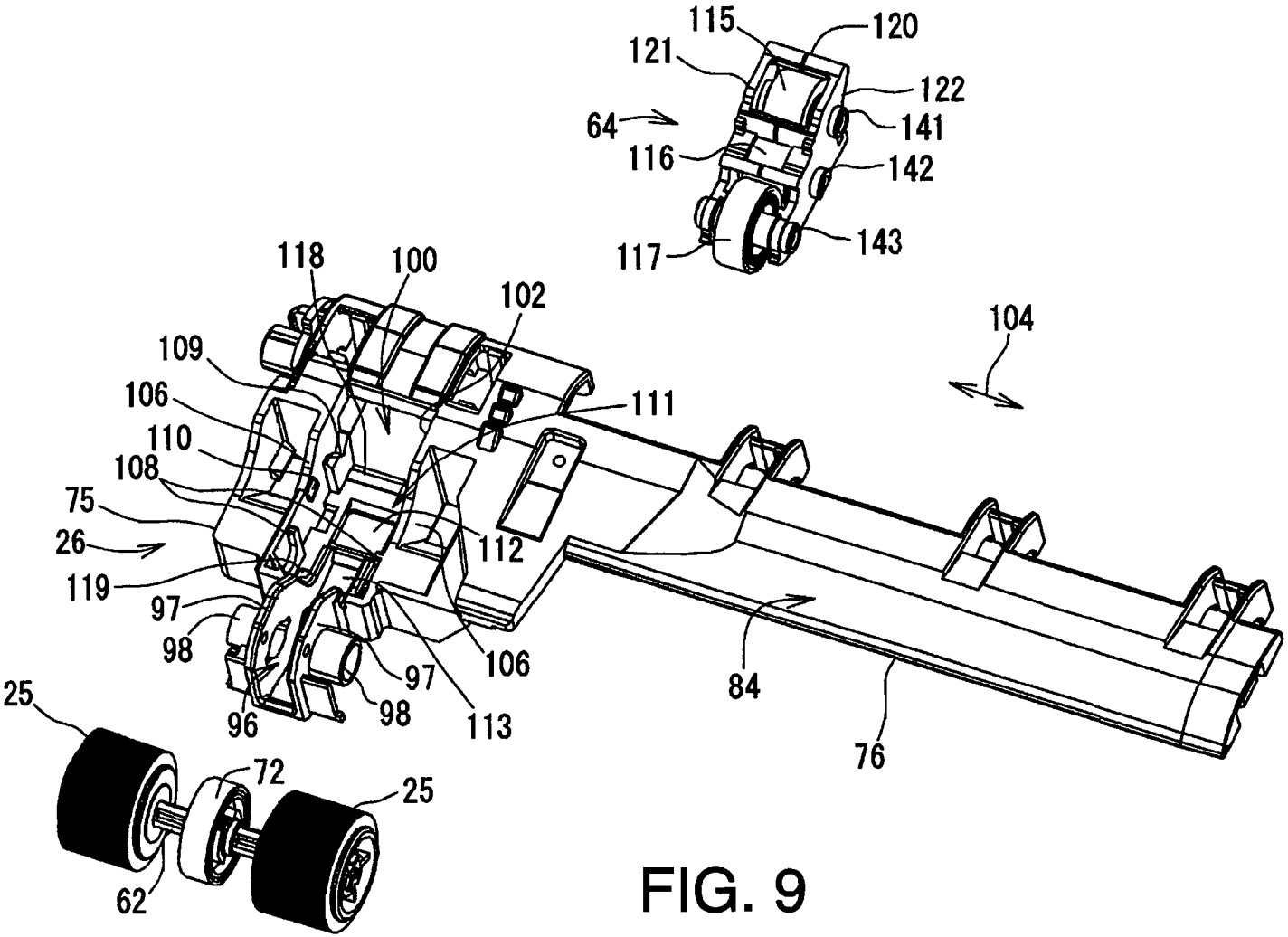
FIG. 9 illustrates an exploded view of the feeding unit 60 of the MFD 10 according to the embodiment of the present invention.
Figure 10:
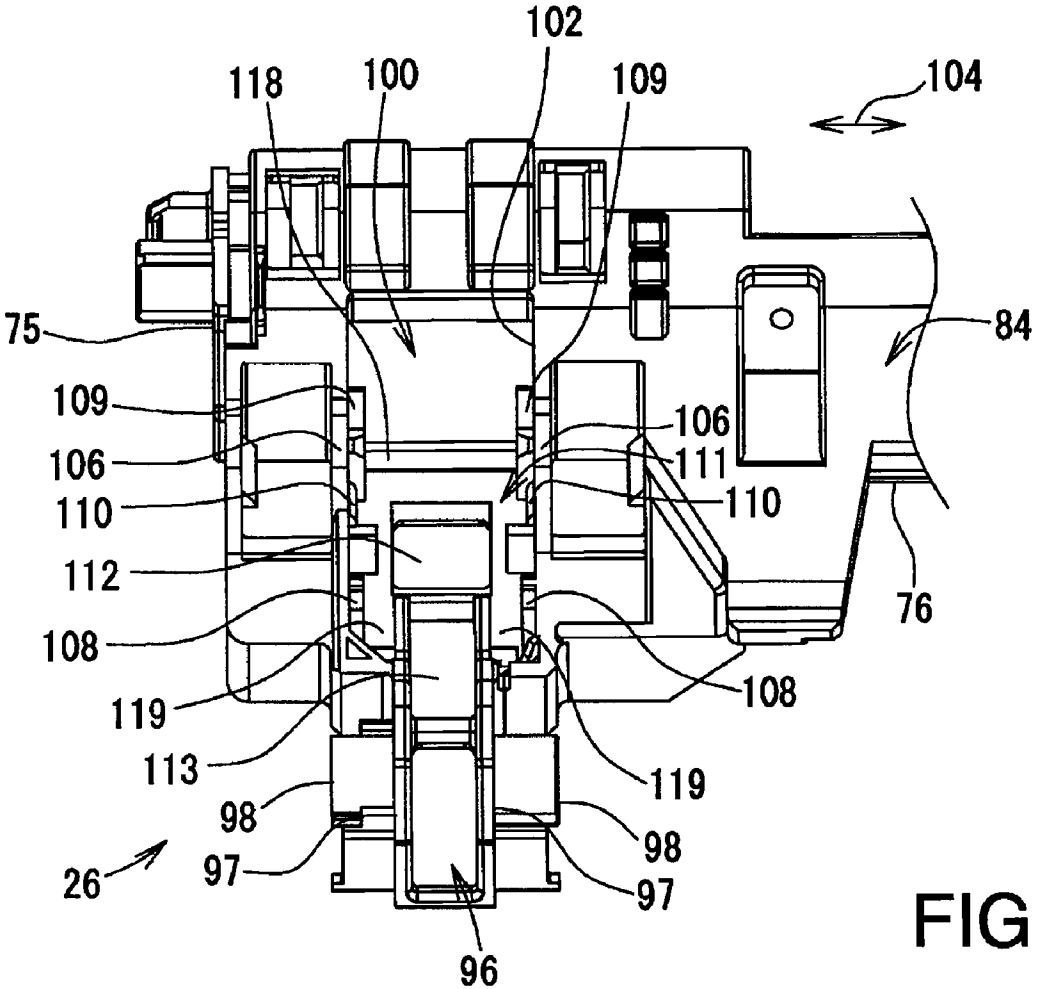
FIG. 10 illustrates an enlarged partial view of a swingable arm 26 in the feeding unit 60 according to the embodiment of the present invention.

Next, configurations and movements of the swingable arm 26, the planetary gear unit 65, and the conveyer gear unit 64 will be described. FIG. 6 illustrates an enlarged perspective view of an encircled portion VI shown in FIG. 3. FIG. 7 illustrates an enlarged perspective view of an encircled portion VII shown in FIG. 4. FIG. 8 illustrates an exploded view of the feeding unit 60 of the MFD 10 according to the embodiment of the present invention. FIG. 9 illustrates an exploded view of the feeding unit 60 of the MFD 10 according to the embodiment of the present invention. FIG. 10 illustrates an enlarged partial view of a swingable arm 26 in the feeding unit 60 according to the embodiment of the present invention.

As shown in FIGS. 3 and 4, the swingable arm 26 includes an arm portion 75 and an extending portion 76. The planetary gear unit 65 and the conveyer gear unit 64 are attached in the arm portion 75. The extending portion 76 extends toward a widthwise center of the MFD 10 from a widthwise end, and the arm portion 75 is provided at the widthwise end of the extending portion 76. The swingable arm 26 is provided with a plurality of (e.g., five) holder portions 79 at an upper end thereof (see FIG. 8). More specifically, the extending portion 76 has three of the holder portions 79, and the arm portion 75 has two of the holder portions 79. Each of the holder portions 79 is formed to have a hole 78, through which the drive shaft 28 is penetrated. The holder portions 79 are arranged in positions which are substantially evenly spaced from neighboring holder portions 79. Thus, the drive shaft 28 penetrated through the holder portions 79 is held by a frame of the printer unit 11 at both ends thereof so that the swingable arm 26 is swingably supported by the frame.

The arm portion 75 is formed to extend from the drive shaft 28 in a direction perpendicular to a longer side (i.e., widthwise side) of the extending portion 76. The arm portion 75 is further formed to have a casing portion 82, in which the planetary gear unit 65 is set, at the upper end of the arm portion 75 in the vicinity of the drive shaft 28. The casing portion 82 is recessed in a direction of a depth of the arm portion 75 from an upper surface level 83. The planetary gear unit 65 is situated in the casing portion 82 through an aperture 85 of the upper surface level 83.

The planetary gear unit 65 transmits rotation force of the drive shaft 28 to the conveyer gear unit 64. The planetary gear unit 65 includes a planet gear 89, an arm portion 88, and a sun gear 87 (see FIG. 5). The sun gear 87 is subject to the rotation force of the drive shaft 28 and rotates integrally with the drive shaft 28. The sun gear 87 is arranged in the vicinity of an end opposite from the conveyer gear 67. The sun gear 87 may be formed integrally with the drive shaft 28. Alternatively, the sun gear 87 may be formed separately from the drive shaft 28 and fixed to the drive shaft 28 afterwards.

As shown in FIG. 8, the arm portion 88 is provided with a cylinder-shaped guide portion 93. The guide portion 93 guides the sun gear 87 to a position in which the sun gear 87 is engageable with the planet gear 89. The guide portion 93 is formed to have a predetermined-sized inner circumference 94, through which the drive shaft 28 can be penetrated and the sun gear 87 is suitably engaged with the planet gear 89 without loosening. The planetary gear unit 65 is situated in the casing portion 82 with the inner circumference 94 of the guide portion 93 aligned to the holes 78 of the holder portions 79. When the drive shaft 28 is inserted through the inner periphery of the guide portion 93 and the openings 78 with the inner circumference 94 being aligned to the holes 78 of the holder portions 79, the sun gear 87 and the planet gear 89 can be correctly engaged with each other.

When the drive shaft 28 rotates with the sun gear 87 engaged with the planet gear 89, the planet gear 89 comes in engagement with and is disengaged from the conveyer gear unit 64. In the present embodiment, when the drive shaft 28 in FIG. 2 rotates in the counterclockwise direction, the planet gear 89 rotates around the sun gear 87 in the counterclockwise direction and comes in engagement with a conveyer gear 115 (see FIG. 5) in the conveyer gear unit 64 so that the rotation of the drive shaft 28 is conveyed to the conveyer gear unit 64 through the planet gear 89. Meanwhile, when the drive shaft 28 in FIG. 2 rotates in the clockwise direction, the planet gear 89 rotates around the sun gear 87 in the clockwise direction to become apart and disengaged from the conveyer gear 115. Therefore, the rotation of the drive shaft 28 is not conveyed to the conveyer gear unit 64.

As shown in FIGS. 7, 9, and 10, the arm portion 75 of the swingable arm 26 is formed to have a casing portion 100, in which the conveyer gear unit 64 is situated. The casing portion 100 is formed in a position at an approximate center of the arm portion 75, in which the casing portion 100 does not interfere with the casing portion 82. An opening 102 of the casing portion 100 can be provided on either upper or lower surface of the arm portion 75, but in the present embodiment, the opening 102 is formed on a lower surface level 84 closer to the sheet tray 20. The casing portion 100 is formed to recess in the direction of the depth of the arm portion 75 from the lower surface level 84. The conveyer gear unit 64 is situated in the casing portion 100 through the opening 102.

The arm portion 75 is further formed to have a pair of partition walls 106, which are opposing each other and define inner surfaces of the casing portion 100 in a widthwise direction 104 of the arm portion 75. The planes of the partition walls 106 are in parallel with each other and perpendicular to an extending direction of the drive shaft 28. Thus, partitioned space of the casing portion 100 is created in between the partition walls 106.

As shown in FIGS. 9 and 10, the casing portion 100 includes a bottom surface 111, which opposes to the opening 102 and recessed in the direction in which the conveyer gear unit 64 is inserted. The bottom surface 111 is formed to have apertures 112, 113. When the conveyer gear unit 64 is situated in the casing portion 100, an intermediate gear 116 and a conveyer gear 117 (see FIGS. 3-7, 9) in the conveyer gear unit 64 are exposed through the aperture 112 and the aperture 113 respectively so that the gears 116, 117 do not interfere with the bottom surface 111. When the conveyer gear unit 64 is situated in the casing 100 to the bottom surface 111, a frame 120 (described later, see FIG. 9) of the conveyer gear unit 64 becomes in contact with a contact portion 118 (see FIGS. 9, 10), which is formed on the bottom surface 111 on a side closer to the casing portion 82, at an arcuate projection 131 (see FIGS. 11-13). At the same time, an arcuate projection 132 (see FIGS. 11-13) of the frame 120 becomes in contact with a contact portion 119 (see FIGS. 9, 10), which is formed on the bottom surface 111 on a side closer to the feed rollers 25. According to the projections 131, 132 being in contact with the contact portions 118, 119 respectively, the conveyer gear unit 64 is situated in a correct position in the depth of the casing portion 100 in the direction from the opening 102 toward the bottom surface 111.

Further, as shown in FIGS. 9 and 10, the casing portion 100 is formed to have a pair of U-shaped grooves 108, each of which has a cross-sectional shape of U with a side closer to the opening 102 being open-ended, and a pair of V-shaped grooves 109, each of which has a cross-sectional shape of V on the partition walls 106 with a side closer to the opening 102 being open-ended. The U-shaped grooves 108 and the V-shaped grooves 109 guide the conveyer gear unit 64 to be in a correct position in the casing portion 100 with respect to a lengthwise direction (i.e., a direction from the drive shaft 28 toward the feed rollers 25) of the arm portion 75. When the conveyer gear unit 64 is situated in the casing portion 100, bosses 143 and bosses 141, which will be described later, come to fit in the U-shaped grooves 108 and in the V-shaped grooves 109 respectively.

Each of the U-shaped grooves 108 is formed on one of the partition walls 106 to oppose to each other. In the present embodiment, the U-shaped grooves 108 are arranged in the casing portion 100 on a side closer to the feed rollers 25. Each of the V-shaped grooves 109 is formed on one of the partition walls 106 to oppose to each other. In the present embodiment, the V-shaped grooves 109 are arranged in the casing portion 100 on a side closer to the drive shaft 28.

Furthermore, the casing portion 100 is formed to have a pair of claws 110 on the partition walls 106. The claws 110 are engaged with bosses 142, which will be described later, when the conveyer gear unit 64 is situated in the casing portion 100. Thus, the conveyer gear unit 64 can be restricted from being unintentionally detached from the casing portion 100.

As shown in FIG. 9, the arm portion 75 is formed to have a pair of holder walls 97, which are in positions to oppose to each other in the widthwise direction 104, to hold the conveyer gear 72 at the swingable end thereof. Space 96 between the holder walls 97 communicates with the casing portion 100. Each of the holder walls 97 is provided with a bearing 98, which projects outward in the widthwise direction 104. When the conveyer gear 72 is settled in the space 96 and the roller shaft 62 is rotatably inserted through openings of the bearings 98 and a shaft hole of the conveyer gear 72, the conveyer gear 72 along with the roller shaft 62 is rotatably held by the arm portion 75. The feed rollers 25 are fixed onto each end of the roller shaft 62.

The conveyer gear unit 64 includes a train of gears, which include the conveyer gear 115, the intermediate gear 116, the conveyer gear 117, and the frame 120 which supports the gears 115, 116, 117 rotatably. According to the present embodiment, the conveyer gear 115 is engaged with the intermediate gear 115, and the intermediate gear 116 is engaged with the conveyer gear 117. Therefore, driving force inputted to the conveyer gear unit 64 is transmitted to the conveyer gear 115, the intermediate gear 116, and the conveyer gear 117, in the order given.

Figure 11:
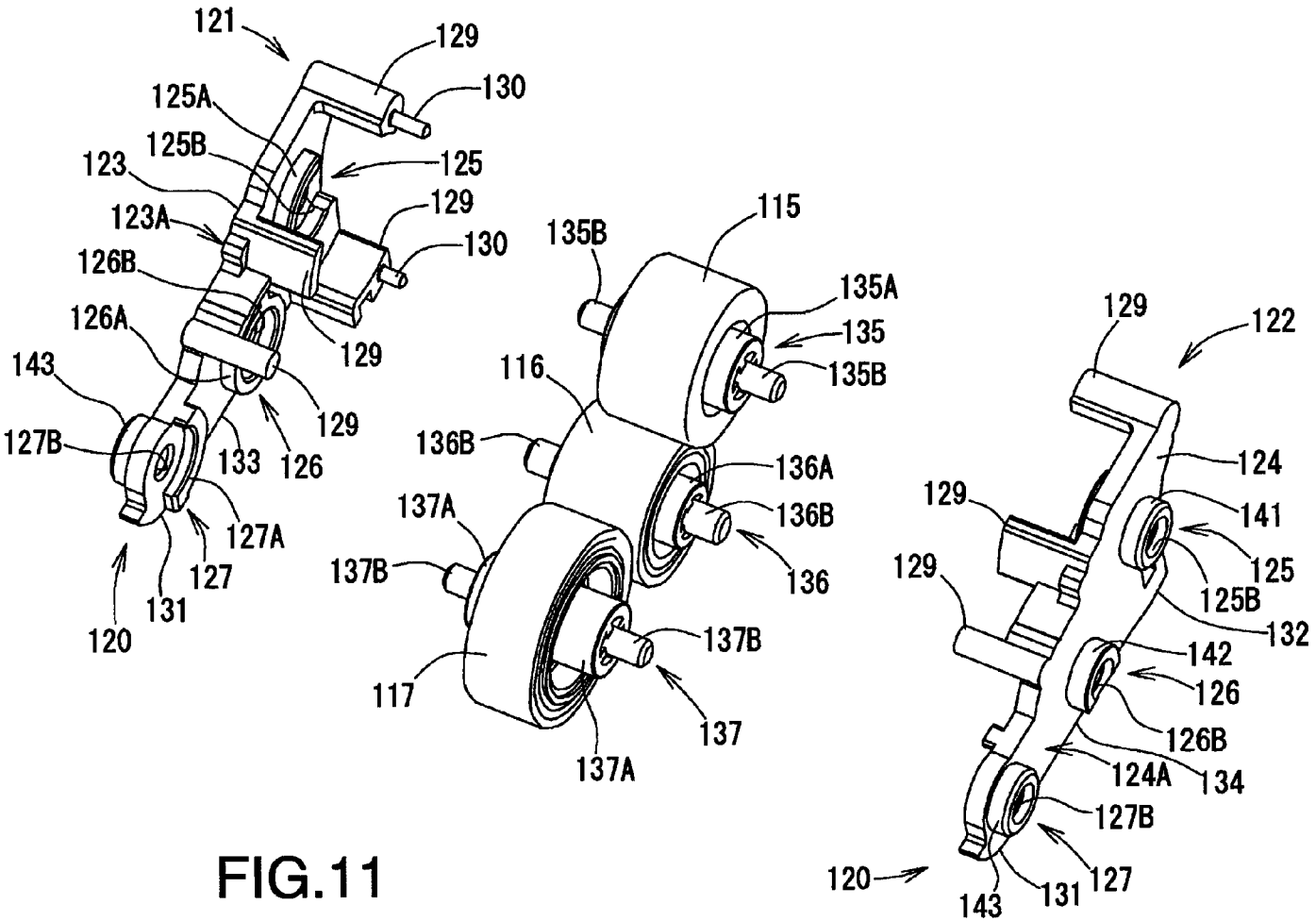
FIG. 11 illustrates an exploded view of a conveyer gear unit 64 in the feeding unit 60 according to the embodiment of the present invention.
Figure 12:
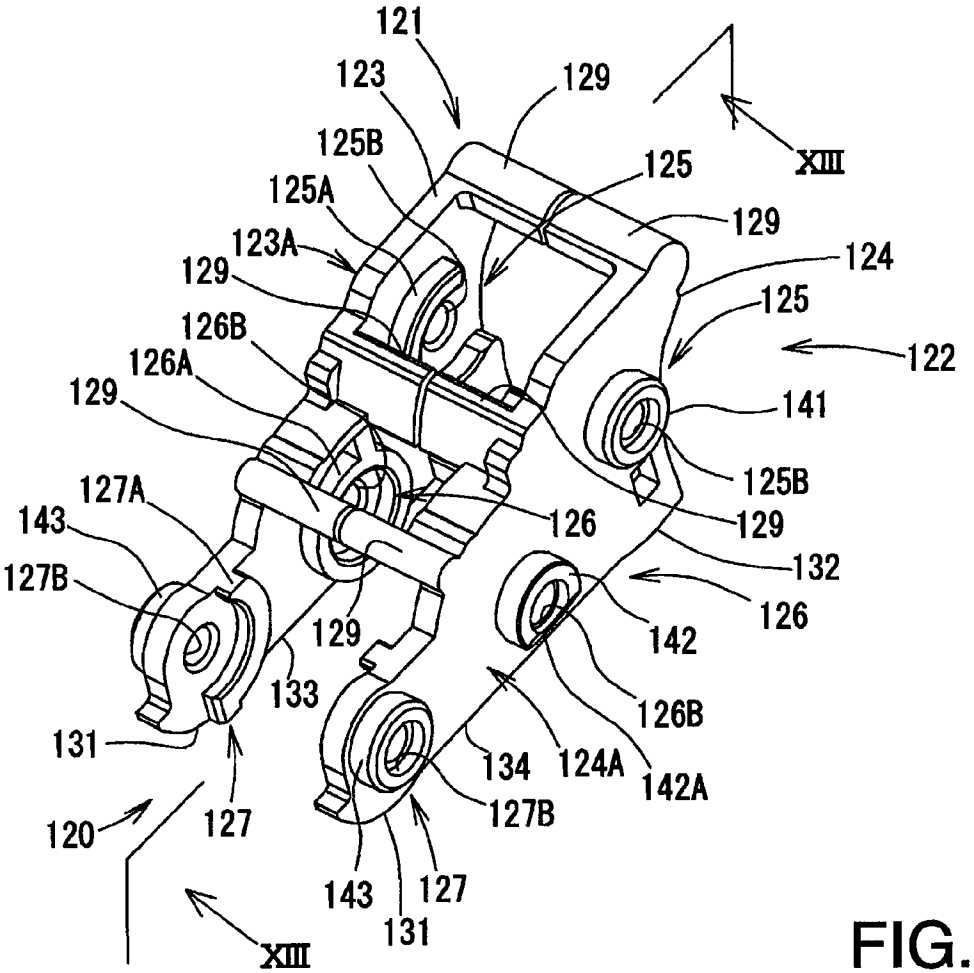
FIG. 12 illustrates a perspective view of a frame 120 in the conveyer gear unit 64 according to the embodiment of the present invention.

FIG. 11 illustrates an exploded view of the conveyer gear unit 64 according to the embodiment of the present invention. FIG. 12 illustrates a perspective view of the frame 120 in the conveyer gear unit 64 according to the embodiment of the present invention.

As shown in FIG. 11, the frame 120 is a frame assembly including a first frame 121 and a second frame 122. The first frame 121 and the second frame 122 are made of synthetic resin, which has higher slidability than the material of the swingable arm 26, and are molded to have similar but symmetry shapes. In the present embodiment, whilst the swingable arm 26 is made of ABS resin, the first and the second frames 121, 122 are made of POM, which has specifically high slidability, although moldability of which is lower than ABS resin. Therefore, abrasion in bearings 125, 126, 127, which will be described later in detail, can be reduced.

The first frame 121 has a supporting wall 123, which comes to face one of the partition walls 106 when the conveyer gear unit 64 is situated in the casing portion 100. Meanwhile, the second frame 122 has a supporting wall 124, which comes to face the other of the partition walls 106 when the conveyer gear unit 64 is situated in the casing portion 100. The supporting walls 123, 124 are formed to have a plurality of ribs 129, which project perpendicularly with respect to the supporting walls 123, 124. When the first frame 121 is assembled with the second frame 122 with the supporting walls 123, 124 facing each other, tip ends of the ribs of the supporting wall 123 come into contact with tip ends of the ribs of the supporting wall 124 (see FIG. 12). Thus, clearance between the supporting walls 123, 124 is maintained steady. The conveyer gear 115, the intermediate gear 116, and the conveyer gear 117 are arranged in the clearance.

Although the first frame 121 and the second frame 122 are formed substantially symmetrically to each other, it is to be noted that one of the first frame 121 and the second frame 122 (i.e., the first frame 121 in the present embodiment) is formed to have pins 130 at tip ends of two ribs 129, which are formed on a side closer to the drive shaft 28 when the conveyer gear unit 64 is situated in the casing portion 100 of the swingable arm 26. On the other hand, the second frame 122 is formed to have bores (not shown) in tip-end portions of two ribs 129, which are formed on the side closer to the drive shaft 28 and correspond to the ribs 129 of the first frame 121 having the pins 130. The pins 130 are inserted into the bores when the first frame 121 and the second frame 122 are assembled; thus, the first frame 121 and the second frame 122 can be easily assembled.

Each of the first frame 121 and the second frame 122 is formed to have a plurality of bearings 125, 126, 127 on the supporting walls 123, 124 respectively. The bearings 125, 126, 127 rotatably support a shaft 135 of the conveyer gear 115, a shaft 136 of the intermediate gear 116, and a shaft 137 of the conveyer gear 137 respectively.

According to the present embodiment, the shafts 135, 136, 137 are formed to have staged cores. More specifically, the shaft 135 has a core 135A, which projects outward in an axial direction from laterals of the conveyer gear 115, and a core 135B, which has a smaller diameter than a diameter of the core 135A and projects further outwardly in the axial direction from laterals of the core 135A. Similarly, the shafts 136, 137 have staged cores 136A, 137A, and cores 136B, 137B respectively.

In correspondence to the shafts 135, 136, 137, the bearings 123, 126, 127 in the first and the second frames 121, 122 are formed to have staged structures. More specifically, the bearings 125 are formed to have bearer portions 125A to hold the core 136A and bearer portions 125B to hold the core 136B respectively. A diameter of the bearer portions 125B is smaller than a diameter of the bearer portions 125A. Similarly, the bearings 126, 127 are formed to have bearer portions 126A, 127A to hold the cores 136A respectively and bearer portions 126B, 127B to hold the cores 137B respectively.

The bearer portions 125B, 126B, 127B are through-holes penetrating through the supporting walls 123, 124. During a normal feeding operation to feed the recording sheets in the feeding direction, the shafts 135, 136, 137 are held by the bearer portions 125B, 126B, 127B at the cores 135B, 136B, 137B respectively.

The bearer portions 125A, 126A, 127A are formed on inner surfaces of the supporting walls 123, 124. The bearer portions 125A, 126A, 127A are round-shaped (e.g., circular, semicircular, or arcuate) ribs which project inward. In the present embodiment, the bearer portions 125A are substantially semicircular ribs. The bearer portions 126A are circular ribs, and the bearer portions 127A are arcuate ribs. During the normal feeding operation, the shaft 135 is held by the bearer portions 125B at the core 135B but not by the bearer portions 125A at the core 135A. Namely, when the core 135B is held by the bearer portions 125B, the core 135A is arranged to have clearance between outer periphery of the core 135A and inner periphery of the bearer portions 125A. Therefore, when the core 135B is subject to unexpected stress and/or excessive rotation torque, which may be caused by, for example, sheet jam in the guide path 22, the core 135 may be deformed; however, the shaft 135 can be supported by the bearer portions 125A at the core 135A. Similarly, the shafts 136, 137 can be held by the bearer portions 126A, 127A at the cores 136A, 137A respectively.

With the shafts 135, 136, 137 being set in the bearings 125, 126, 127, the conveyer gear 115, the intermediate gear 116, and the conveyer gear 117 are rotatably supported by the supporting walls 123, 124 of the frame 120.

Further, the first and the second frames 121, 122 are formed to have bosses 141, 142, 143, in positions which correspond to the bearer portions 125B, 126B, 127B respectively on outer surfaces 123A, 124A of the supporting walls 123, 124. The bosses 141, 142, 143 are circular ribs, which substantially encircle the circumferences of the bearer portions 125B, 126B, 127B respectively and project outward from the outer surfaces 123A, 124A. The bosses 143 are fitted in the U-shaped grooves 108 in the casing portion 100 when the conveyer gear unit 64 is situated in the casing portion 100 of the swingable arm 26. The bosses 141 are fitted in the V-shaped grooves 109 in the casing portion 100. The bosses 142 are engaged with the claws 110 formed on the partition walls 106 in the casing portion 100. The bosses 142 are formed to have beveled portions 142A so that the bosses 142 can be easily engaged with the claws 110.

Figure 13:
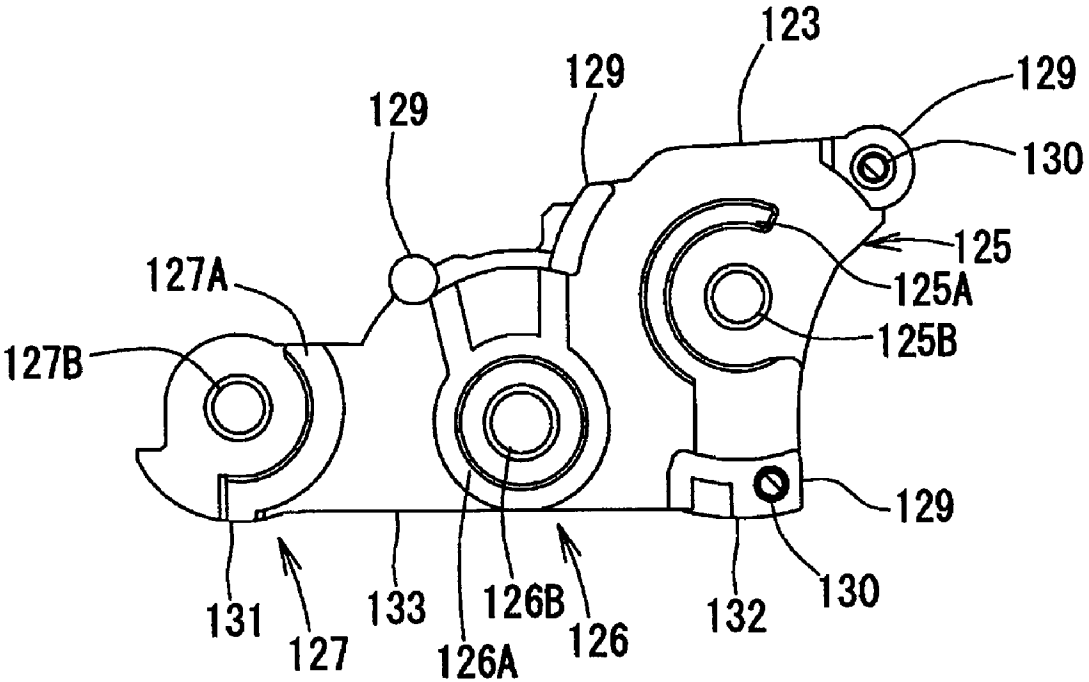
FIG. 13 is a cross-sectional side view of the frame 120 taken from a line XIII-XIII shown in FIG. 12.

FIG. 13 is a cross-sectional side view of the frame 120 taken from a line XIII-XIII shown in FIG. 12. The supporting walls 123, 124 are formed to have arcuate projections 131, 132 on edges 133, which is a side closer to the bottom surface 111 of the casing portion 100 when the conveyer gear unit 64 is situated in the casing portion 100. More specifically, the projections 131 are provided on the edges 133 and on a side closer to the bearings 127. Meanwhile, the projections 132 are provided on the edges 133 and on a side closer to the bearings 125. The edges 133 are formed to be substantially flat in a center portion between the projections 131, 133 whilst the projections 131, 132 are projected downward from the flat portion. When the conveyer gear unit 64 is situated in the casing 100 to the bottom surface 111, the projections 131, 132 become in contact with the contact portions 118, 119 respectively so that the conveyer gear unit 64 is situated in the correct position in the depth of the casing portion 100. It is to be noted that the projections 131, 132 may be omitted, and the edges 133, 134 may be in contact with the contact portions 118, 119 in order to situate the conveyer gear unit 64 in the correct position of the casing portion 100.

When the conveyer gear unit 64 is installed in the casing portion 10, a side having the conveyer gear 117 of the conveyer gear unit 64 is inserted firstly in the casing portion 100 through the opening 102, and the bosses 143 are fitted in the U-shaped grooves 108.Thus, the conveyer gear unit 64 can be placed in an approximate position in the lengthwise direction of the arm portion 75. Thereafter, a side having the conveyer gear 115 of the conveyer gear unit 64 is pressed into the casing portion 100. In this regard, the beveled portions 142A of the bosses 142 come into contact with the claws 110 so that the partition walls 106 are pressed outward by the bosses 142 to be apart from each other. When the conveyer gear unit 64 is pressed further into the casing portion, the bosses 141 are fitted in the V-shaped grooves 109, the bosses 142 pass over the claws 110, and the bosses 142 become engaged with the claws 110. Therefore, the conveyer gear unit 64 is restricted from being displaced in the direction of depth of the casing portion 100. Namely, the conveyer gear unit 64 can be prevented from being unintentionally detached from the casing portion 100 by the engagement of the bosses 142 and the claws 110. In this position, the conveyer gear unit 64 may be movable in the direction in which the conveyer gear unit 64 is inserted toward the opening 102, when the feed rollers 25 rotate in the feeding direction 91, the conveyer gear unit 64 is pressed toward the bottom surface 111. Therefore, the projections 131, 132 become in contact with the contact portions 118, 119 so that the conveyer gear unit 64 can be in the correct position within a predetermined allowable range.

Figure 14B:
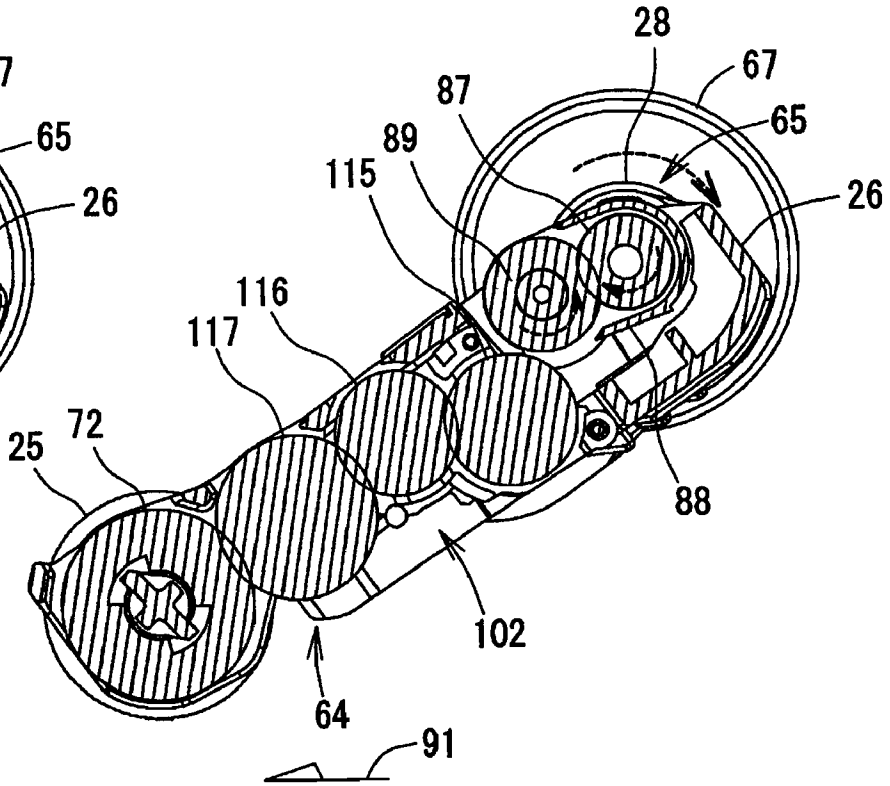
FIGS. 14A and 14B are cross-sectional side views of the feeding unit 60 taken from a line XIV-XIV shown in FIG. 6.
Figure 14A:
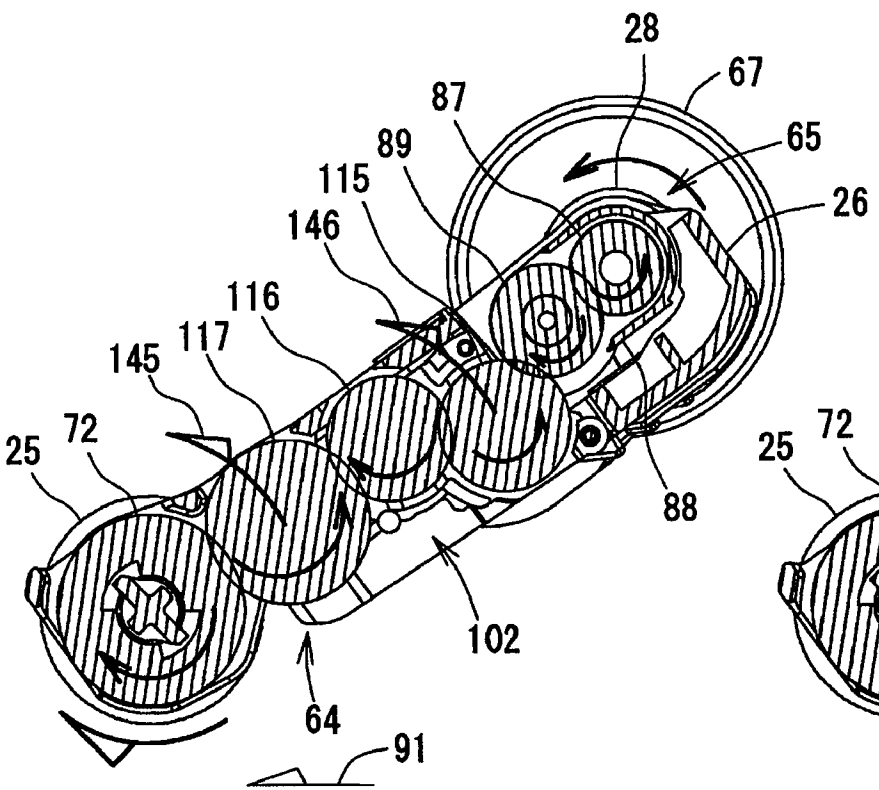

Next, behaviors of the feeding unit 60 will be described with reference to FIGS. 14A, 14B. FIGS. 14A and 14B are cross-sectional side views of the feeding unit 60 taken from a line XIV-XIV shown in FIG. 6. In FIG. 14A, the feeding unit 60 with the drive shaft 28 being rotated in the counterclockwise direction is illustrated. In FIG. 14B, the feeding unit 60 with the drive shaft 28 being rotated in the clockwise direction is illustrated.

When the motor 36 is rotated by the motor driver (not shown) in a predetermined direction, the rotation is conveyed to the drive shaft 28 through the output shaft 37, the drive force conveyer system 27, and the conveyer gear 67. According to the gear arrangement in the present embodiment, the motor 36 is rotated in a direction to rotate the drive shaft in the counterclockwise direction.

As shown in FIG. 14A, when the drive shaft 28 rotates in the counterclockwise direction, the sun gear 87 is rotated in the same direction accordingly. In this regard, the planet gear 89 revolves around the sun gear 87 in the counterclockwise direction to come engaged with the conveyer gear 115. Thus, the rotation of the planet gear 89 can be conveyed to and further from the conveyer gear 115. Because the planet gear 89 is rotated by the rotation of the sun gear 87 in the clockwise direction, the conveyer gear 115 is rotated in the counter clockwise direction. When the rotation of the conveyer gear 115 is transmitted to the conveyer gear 72 through the intermediate gear 116 and the conveyer gear 117, the feed rollers 25 are rotated in the clockwise direction. Accordingly, the recording sheet being in contact with the outer peripheries of the feed rollers 25 is fed in the feeding direction 91. Assuming that the motor 36 is activated to rotate the feed rollers 25 in the opposite direction from the feeding direction, due to the presence of the planetary gear unit 65 between the drive shaft 28 and the conveyer gear unit 64, the planet gear 89 is disengaged from the conveyer gear 115, as shown in FIG. 14B; therefore, transmission of the rotation to the conveyer gear unit 64 is shut off by the planetary gear unit 65. Thus, the planetary gear unit switches transmission and blocking of the rotation to the conveyer gear unit 64 according to the direction of the inputted rotation.

During the feeding operation of the feed rollers 25, the feed rollers 25 are subject to stress in the direction opposite from the feeding direction due to friction generated between the feed rollers 25 and the recording sheet. The stress to the feed rollers 25 causes the conveyer gear 117, which is rotated by the rotation torque of the motor 36, to move in the counterclockwise direction (as indicated by an arrow 145 in FIG. 14A) around the conveyer gear 72 about an axis of the conveyer gear 72. In this regard, the shaft 137 of the conveyer gear 117 upthrusts the bearings 127 in the direction indicated by the arrow 145. Therefore, a lower side of the frame 120 closer to the feed rollers 25 becomes in contact with the contact portion 119 on the bottom surface 111 with the projections 132, and the frame 120 can be set in the correct position with respect to the casing portion 100 within the predetermined allowable range. The stress to the feed rollers 25 further affects the conveyer gear 116 through the conveyer gear 72 and the conveyer gear 117. Therefore, the conveyer gear 115 is moved around the conveyer gear 116 about an axis of the conveyer gear 116 in the counterclockwise direction (as indicated by an arrow 146 in FIG. 14A). In this regard, the shaft 135 of the conveyer gear 115 upthrusts the bearings 125 in the direction indicated by the arrow 146. Therefore, an upper side of the frame 120 closer to the planetary gear unit 65 becomes in contact with the contact portion 118 on the bottom surface 111 with the projections 131, and the frame 120 can be set in the correct position with respect to the casing portion 100 within the predetermined allowable range. Thus, when the feed rollers 25 are rotated in the feeding direction, the shaft 137 of the conveyer gear 117 and the shaft 135 of the conveyer gear 115 press the frame 120 toward the bottom of the casing portion 100 so that the conveyer gear unit 64 can be situated in the correct position in the casing portion 100.

Thus, the conveyer gear unit 64 can be settled easily in the correct position with the above-described simplified configuration according to the rotation of the feed rollers 25.

In the above embodiment, the conveyer gear unit 64 includes three (i.e., an odd-number of) gears, which are the conveyer gear 115, the intermediate gear 116, and the conveyer gear 117. Therefore, the gears at each end of the gear train are moved toward the substantially same direction when the feed rollers 25 are subject to the stress from the recording sheets. It is to be noted that the gears at each end of the train gear are moved toward the same direction when the conveyer gear unit 64 includes three or more and odd-numbered gears. Therefore, the conveyer gear unit 64 may include three or more and odd-numbered gears. It may be noted that, when the conveyer gear unit includes a single gear, the gear is pressed toward the bottom of the casing portion 100 according to the rotation of the feed rollers 25.

When the conveyer gear unit 64 includes two or more and even-numbered gears, a gear directly engaged with the conveyer gear 72 at one end of the gear train is moved toward the bottom of the casing portion 100, and a gear at the other end of the gear train is moved toward the opening 102. Therefore, when the conveyer gear unit 64 includes two or more and even-numbered gears, a restricting structure to restrict the gear at the other end of the gear train from being moved toward the opening 102.

In the above embodiment, the swingable arm 26 is made of ABS resin whilst the frame 120 is made of POM, which has higher slidability than ABS resin. Therefore, the swingable arm 26 provides higher dimensional accuracy and rigidity whilst the frame can prevent abrasion which may be caused by rotational friction.

In the above embodiment, the shafts 135, 135, 137 has staged cores; therefore, when the cores 135B, 136B, 137B are distorted by large rotation torque, the gears 115, 116, 117 are supported by the cores 135A, 136A, 137A, and the shafts 135B, 136B, 137B can be prevented from being corrupted.

Further, in the above embodiment, the planetary gear unit 65 between the drive shaft 28 and the conveyer gear unit 64 can prevent the reverse rotation of the drive shaft 28 from being transmitted to the conveyer gear unit 64. Therefore, when the motor 36 rotates in a direction opposite from the feeding direction, the rotation is absorbed by the planetary gear unit 65. When, for example, the reverse rotation is not absorbed by the planetary gear unit 65 but transmitted to the conveyer gear unit 64, the conveyer gears 115, 117 are moved toward the opening 102, and the conveyer gear unit 64 may be detached from the casing portion 100. However, in the above embodiment, the conveyer gear unit 64 is prevented from being unintentionally detached.

It is to be noted that, however, the planetary gear unit 65 may not necessarily be arranged between the drive shaft 28 and the conveyer gear unit 64, but may be arranged, for example, in the drive force conveyer system 27 as long as it is arranged on the upstream side than the conveyer gear unit 64 in the sheet feeding path. Further, the planetary gear unit 65 may even be omitted when the motor 36 is controlled to rotate solely in the feeding direction.

Furthermore, in the above embodiment, the conveyer gear unit 64 is situated in the correct position in the direction to be inserted in the casing portion 100 by the projections 131, 132 being brought into contact with the contact portions 118, 119 respectively. However, the position of the conveyer gear unit 64 with respect to the arm portion 75 may be determined by having the bosses 143 in contact with bottom portions of the U-shaped grooves 108 and the bosses 141 in contact with bottom portions of the V-shaped grooves.

Although an example of carrying out the invention has been described, those skilled in the art will appreciate that there are numerous variations and permutations of the feeder unit, the sheet feeding device, and an image reading apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. A feeder unit to feed sheets, which are stacked in a tray, in a predetermined feeding direction, comprising:

a main frame, having a pivotal end and a swingable end, being swingably supported at the pivotal end by a first shaft arranged substantially above the tray, having an upper surface and a lower surface, and arranged to extend from the first shaft toward an upper level of the tray with the lower surface facing the tray;

a rotary member, which is arranged at the swingable end of the main frame, is rotatably supported by a second shaft extending in a same direction with the first shaft, and is arranged to come in contact with a topmost surface of the sheets stacked in the tray;

a pair of opposing walls, which are formed in the main frame, and of which planes are perpendicular to the direction of the first shaft;

a secondary frame, having a pair of supporting walls which come to face the opposing walls when the secondary frame is inserted in space partitioned by the opposing wall in the main frame through an opening, the opening formed on either surface of the main frame;

a gear train including a plurality of gears to transmit predetermined rotation force to the rotary member, each of the gears being rotatable about a third shaft extending in the same direction with the first shaft and is rotatably supported by the pair of supporting walls;

a positioning system to situate the secondary frame in a predetermined position in the partitioned space; and a detachment restricting system to restrict the secondary frame from being detached from the main frame, wherein the secondary frame is situated in the predetermined position of the main frame when the rotary member rotates in a direction to feed the sheets.

2. The feeder unit according to claim 1, wherein the gear train includes an odd number of gears; and wherein the positioning system defines a position of the secondary frame in a direction of depth of the partitioned space, which directs from the opening toward a bottom portion of the partitioned space.

3. The feeder unit according to claim 1, wherein the positioning system defines a position of the secondary frame in a direction of length of the partitioned space of the main frame, which extends from the first shaft toward the rotary member.

4. The feeder unit according to claim 1, wherein the main frame is in an attitude to orient a downstream side of the feeding direction from the first shaft; and wherein the opening is provided on the lower surface of the main frame facing the tray.

5. The feeder unit according to claim 1, wherein the main frame and the secondary frame are molded out of synthetic resin; and wherein the secondary frame is made of synthetic resin having slidability higher than slidability of the main frame.

6. The feeder unit according to claim 1, wherein the positioning system situates the secondary frame in the predetermined position in the direction of depth of the partitioned space by having the secondary frame in contact with a predetermined contact portion, which is provided on the bottom portion of the partitioned space.

7. The feeder unit according to claim 1, wherein the positioning system includes a pair of grooved portions, each of which is formed on either one of the opposing walls, and a pair of bearer portions, each of which is formed on either one of the supporting walls and engageable with one of the grooved portions.

8. The feeder unit according to claim 7, wherein each of the supporting walls is formed to have a shaft hole, which rotatably supports the third shaft, and is arranged on each lateral side of the gear in the gear train; and wherein each of the bearer portions is formed to project outward from an outer surface of the supporting wall in a position corresponding to the shaft hole.

9. The feeder unit according to claim 8, wherein the shaft hole is a through-hole penetrating through the supporting wall; and wherein the bearer portion is a round-shaped rib to encircle the through-hole of the shaft hole on the outer surface of the supporting wall.

10. The feeder unit according to claim 7, wherein the grooved portions include a pair of first grooves, which are formed on a side of the opposing walls closer to the first shaft, and a pair of second grooves, which are formed on a side of the opposing walls closer to the rotary member;

wherein each of the first grooves is formed to have a cross-sectional shape of U with a side closer to the opening being open-ended;

wherein each of the second grooves is formed to have a cross-sectional shape of V with a side closer to the opening being open-ended; and wherein the bearer portions include a pair of first bearer, each of which is inserted in one of the first grooves, and a pair of second bearer, each of which is inserted in one of the second grooves.

11. The feeder unit according to claim 1, wherein each of the third shafts is formed to have a first core, which projects from lateral sides of the gear outward in an axial direction of the gear, and a second core, which has a diameter smaller than a diameter of the first core and projects further outward in the axial direction from laterals of the first core; and wherein the secondary frame is formed to have a pair of first bearings to hold the first core and a pair of second bearings to hold the second core.

12. The feeder unit according to claim 1, wherein the pair of supporting walls includes a first wall to hold one end of each third shaft and a second wall to hold the other end of each third shaft.

13. The feeder unit according to claim 1, further comprising:

a transmission switching system to switch transmission of rotation generated by an external drive source to the gear train, wherein the transmission switching system transmits the rotation in a first direction to the gear train; and wherein the transmission switching system restricts the rotation in a second direction, which is opposite from the first direction, from being transmitted to the gear train.

14. The feeder unit according to claim 13, wherein the transmission switching system includes a sun gear, which is rotated by the external drive source, and a planet gear, which is engageable with the sun gear to rotate around the sun gear and is engaged with and disengaged from the gear train in accordance with the direction of rotation from the drive source.

15. The feeder unit according to claim 14, wherein the planet gear is engaged with the gear train to transmit the rotation when the rotation generated by the external drive source is in the first direction; and wherein the planet gear is disengaged from the gear train to block the rotation when the rotation generated by the external drive source is in the second direction.

16. The feeder unit according to claim 1, wherein the secondary frame is situated in the predetermined position of the main frame by thrusting force generated by the rotation of the rotary member.

17. The feeder unit according to claim 16, wherein the positioning system defines a position of the secondary frame in a direction of depth of the partitioned space, which directs from the opening toward a bottom portion of the partitioned space.

18. The feeder unit according to claim 1, wherein the detachment restricting system includes a pair of a claw and a boss, which are engageable with each other.

19. A sheet feeding device, comprising:

a feeder unit to feed sheets in a sheet stack in a predetermined feeding direction;

a transmission system to transmit rotating force from a drive source to the feeder unit; and a tray to contain the sheet stack, wherein the feeder unit includes:

a main frame, having a pivotal end and a swingable end, being swingably supported at the pivotal end by a first shaft arranged substantially above the tray, having an upper surface and a lower surface, and arranged to extend from the first shaft toward an upper level of the tray with the lower surface facing the tray;

a rotary member, which is arranged at the swingable end of the main frame, is rotatably supported by a second shaft extending in a same direction with the first shaft, and is arranged to come in contact with a topmost surface of the sheets stacked in the tray;

a pair of opposing walls, which are formed in the main frame, and of which planes are perpendicular to the direction of the first shaft;

a secondary frame, having a pair of supporting walls which come to face the opposing walls when the secondary frame is inserted in space partitioned by the opposing wall in the main frame through an opening, the opening formed on either surface of the main frame;

a gear train including a plurality of gears to transmit predetermined rotation force to the rotary member, each of the gears being rotatable about a third shaft extending in the same direction with the first shaft and is rotatably supported by the pair of supporting walls;

a positioning system to situate the secondary frame in a predetermined position in the partitioned space; and a detachment restricting system to restrict the secondary frame from being detached from the main frame; and wherein the secondary frame is situated in the predetermined position of the main frame when the rotary member rotates in a direction to feed the sheets.

20. An image forming apparatus, comprising:

a feeder unit to feed sheets in a sheet stack in a predetermined feeding direction;

a transmission system to transmit rotating force from a drive source to the feeder unit; and a tray to contain the sheet stack;

an image forming unit to form images on the sheets being fed, wherein the feeder unit includes:

a main frame, having a pivotal end and a swingable end, being swingably supported at the pivotal end by a first shaft arranged substantially above the tray, having an upper surface and a lower surface, and arranged to extend from the first shaft toward an upper level of the tray with the lower surface facing the tray;

a rotary member, which is arranged at the swingable end of the main frame, is rotatably supported by a second shaft extending in a same direction with the first shaft, and is arranged to come in contact with a topmost surface of the sheets stacked in the tray;

a pair of opposing walls, which are formed in the main frame, and of which planes are perpendicular to the direction of the first shaft;

a secondary frame, having a pair of supporting walls which come to face the opposing walls when the secondary frame is inserted in space partitioned by the opposing wall in the main frame through an opening, the opening formed on either surface of the main frame;

a gear train including a plurality of gears to transmit predetermined rotation force to the rotary member, each of the gears being rotatable about a third shaft extending in the same direction with the first shaft and is rotatably supported by the pair of supporting walls;

a positioning system to situate the secondary frame in a predetermined position in the partitioned space; and a detachment restricting system to restrict the secondary frame from being detached from the main frame; and wherein the secondary frame is situated in the predetermined position of the main frame when the rotary member rotates in a direction to feed the sheets.

* * * * *